US010151085B2

(12) United States Patent
Chong et al.

(10) Patent No.: US 10,151,085 B2
(45) Date of Patent: Dec. 11, 2018

(54) APRON SINK

(71) Applicant: Elkay Manufacturing Company, Oak Brook, IL (US)

(72) Inventors: Jonathan Chee Yeen Chong, Chicago, IL (US); Robert Zudic, Chicago, IL (US); Erik Lynch, Downers Grove, IL (US); Christopher Waas, North Riverside, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 0 days.

(21) Appl. No.: 15/399,406

(22) Filed: Jan. 5, 2017

(65) Prior Publication Data

US 2018/0187401 A1 Jul. 5, 2018

(51) Int. Cl.
*E03C 1/18* (2006.01)
*A47K 1/04* (2006.01)

(52) U.S. Cl.
CPC . *E03C 1/18* (2013.01); *A47K 1/04* (2013.01)

(58) Field of Classification Search
CPC ..... E03C 1/18
USPC ..... 4/619–660
See application file for complete search history.

(56) References Cited

U.S. PATENT DOCUMENTS

| | | | |
|---|---|---|---|
| 1,453,945 | A | 5/1923 | Peterson |
| 2,450,702 | A | 10/1948 | Watts |
| D353,652 | S | 12/1994 | Dannenberg |
| 5,551,103 | A | 9/1996 | Drozdowich et al. |
| 5,743,501 | A | 4/1998 | Rapp |
| 5,864,898 | A | 2/1999 | Knapp et al. |
| 5,940,906 | A | 8/1999 | Halloran |
| 6,108,831 | A | 8/2000 | Lombreglia, Jr. |
| D560,773 | S | 1/2008 | Kitzmiller |
| 7,377,661 | B2 | 5/2008 | Douglass |
| D651,699 | S | 1/2012 | Booth et al. |
| D655,798 | S | 3/2012 | Miller et al. |
| D662,574 | S | 6/2012 | Booth et al. |
| D663,389 | S | 7/2012 | Miller et al. |
| D663,395 | S | 7/2012 | Miller et al. |
| D670,364 | S | 11/2012 | Miller et al. |
| D670,366 | S | 11/2012 | Booth et al. |
| D670,367 | S | 11/2012 | Miller et al. |
| D671,197 | S | 11/2012 | Miller et al. |

(Continued)

FOREIGN PATENT DOCUMENTS

DE 10 2008 049 794 A1 4/2010

OTHER PUBLICATIONS

"Kitchen Sinks: Farmhouse Sink with Stainless Steel Backsplash," Just Manufacturing, http://www.justsinks.com/farmhouse-sink-w-backsplash/ (Nov. 8, 2016).

(Continued)

*Primary Examiner* — Lori Baker
(74) *Attorney, Agent, or Firm* — Leydig, Voit & Mayer, Ltd.

(57) ABSTRACT

A sink includes a basin body having a generally concave shape that forms at least one sink basin, a top flange integrally formed with the basin body, the top flange extending around a rim of the at least one sink basin, the top flange having an underside that is generally flat, an apron connected onto a front portion of the underside of the top flange, and an adhesive disposed between the apron and the underside of the top flange to secure the apron to the basin body.

9 Claims, 6 Drawing Sheets

(56) References Cited

U.S. PATENT DOCUMENTS

| | | | |
|---|---|---|---|
| D675,300 | S | 1/2013 | Miller et al. |
| 8,418,281 | B2 | 4/2013 | Sutter |
| 8,661,577 | B2 | 3/2014 | Cusimano |
| 8,844,070 | B2 | 9/2014 | Booth et al. |
| 9,115,484 | B2 | 8/2015 | Fulford et al. |
| 9,173,487 | B2 | 11/2015 | Booth et al. |
| 9,486,113 | B2 | 11/2016 | Zimbric |
| 9,492,010 | B2 | 11/2016 | Booth et al. |
| 9,492,011 | B2 | 11/2016 | Booth et al. |
| 2009/0314730 | A1 | 12/2009 | Mansikkamaa |
| 2010/0275367 | A1 | 11/2010 | Bager et al. |
| 2015/0059084 | A1 | 3/2015 | Hocaoglu |
| 2015/0230667 | A1 | 8/2015 | Palazzolo et al. |

OTHER PUBLICATIONS

"30" Baldwin Fireclay Farmhouse Sink—Fluted Apron—White," http://www.signaturehardware.com/kitchen/kitchen-sinks/farmhouse-sinks/30-baldwin-fireclay-farmhouse-sink-fluted-front-white.html (2016).

"Kohler K 3935 4 NA Vault 30" Single Basin Top Mount 18 Gauge Stainless Steel Kitchen Sink with Self Trimming," Item #: bci1867766 https://www.faucetdirect.com/kohler-k-3935-4-vault-30-single-basin-top-mount-18-gauge-stainless-steel-kitchen-sink-with-self-trimming/p1867766?gclid_CKut9WWmtACFQ-DaQodGm4N-Q&Source_gg-gba-pla_1867766_40787936723&s_kwcid=AL!3775!3!40787936723!!!g!1567295123! (2016).

APRON SINK

FIELD OF THE DISCLOSURE

The present disclosure relates to sinks and, more particularly, sinks with aprons.

BACKGROUND OF THE INVENTION

Composite materials such as engineered stone, which is a composite material made from crushed stone that is bound together by an adhesive such as polymer resin, are gaining popularity for making various household articles and fixtures, including sinks and countertops. One common stone used for producing engineered stone sinks and other household fixtures is quartz. Related materials include geopolymers and cast stone. Unlike other materials, some items made from engineered stone such as sinks are molded to produce a desired shape and surface finish or texture. When molding an engineered-stone sink, an uncured mixture of stone and binder are placed in a closed mold to cure. Upon curing, the now solid article is removed from the mold and subjected to finishing operations such as trimming, machining, polishing and the like.

Typical sink molds are made of two pieces, a lower mold and an upper mold. The lower mold typically shapes the exterior of the sink, and also any other sink features such as an apron. The upper mold shapes the interior of the sink and, usually, a top flange surface used to mount the sink to the underside of a countertop. To allow extraction of the cured sink from the lower mold, and also the upper mold, draft angles are designed in connection with the various sink surfaces and edges. The draft angles, which are typical for molded articles, can range between 0.5 and 5 degrees, depending on the size and shape of the molded features and the surface texture of the various faces, especially the surfaces extending along a mold separation direction. While the draft angles are necessary, they affect the shape of the sink, which can detract from its aesthetics in certain applications.

SUMMARY OF THE DISCLOSURE

The disclosure describes an apron sink that includes a sink body and a generally rectangular apron. In one aspect, the disclosure describes a sink. The sink includes a basin body having a generally concave shape that forms at least one sink basin, a top flange integrally formed with the basin body, the top flange extending around a rim of the at least one sink basin, the top flange having an underside that is generally flat, an apron connected onto a front portion of the underside of the top flange, and an adhesive disposed between the apron and the underside of the top flange to secure the apron to the basin body.

In another aspect, the disclosure describes a method for manufacturing an engineered stone sink. The method includes molding a basin body having draft angles configured for a vertical mold separation direction relative to an installation orientation of the sink, molding an apron having draft angles configured for a horizontal mold separation direction relative to the installation orientation of the sink, applying an adhesive between the basin body and the apron, bringing together and aligning the basin body and the apron, and clamping the basin body and the apron at least until the adhesive cures.

DETAILED DESCRIPTION

The present disclosure is applicable for fixtures such as sinks that are made by a molding process using a composite material that includes stone, such as quartz, and a binder. In the exemplary embodiment illustrated herein a single basin sink having an apron is shown but it should be appreciated that the structures and methods discussed herein are equally applicable for other sink designs and configurations.

Figure 1:
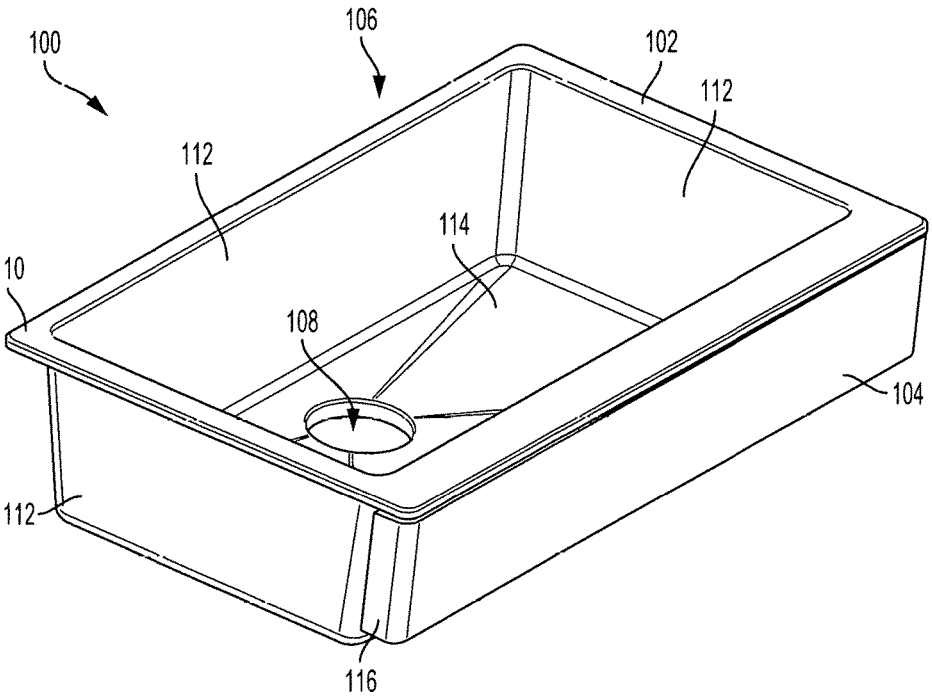
FIG. 1 is an outline view of a sink having an apron in accordance with the disclosure.

A sink 100 is shown in FIG. 1. The sink 100 is a molded, quartz sink that, unlike similar sinks, is made of two parts that are connected to one another, as will become evident from the discussion that follows. The sink 100 includes a basin body 102 that is connected to an apron 104. The basin body 102, which for illustration includes a single bowl but may alternatively include more than a single bowl separated by divider walls, in the known configuration, includes an inner, concave area 106 having a drain opening 108. The basin body 102 includes a top flange 110 configured to be attached on the underside of a countertop surface (not shown) and retained thereon by clips (not shown) in a known arrangement. In the illustrated embodiment, the top flange 110 is coextensive in a lateral direction with the outermost lateral edges of the apron 104. The basin body 102 includes four side walls 112 surrounding a floor 114 having a generally rectangular shape. The floor 114 includes slanted sections to facilitate water drainage towards the drain opening 108, which is formed in the floor.

Figure 2:
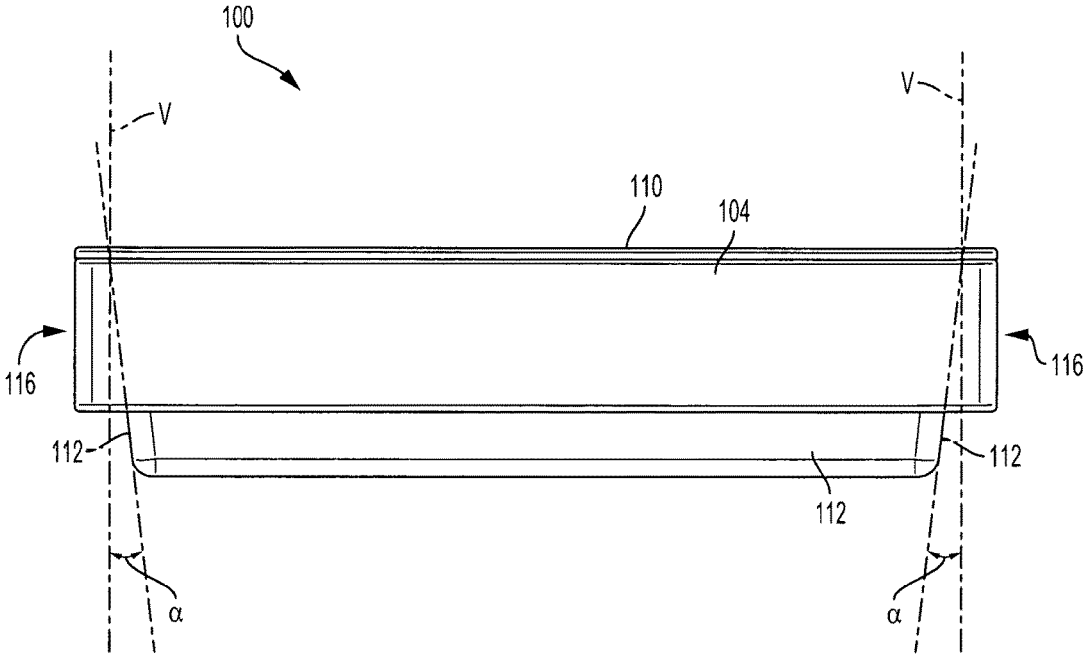
FIG. 2 is a front view of the sink shown in FIG. 1.
Figure 3:
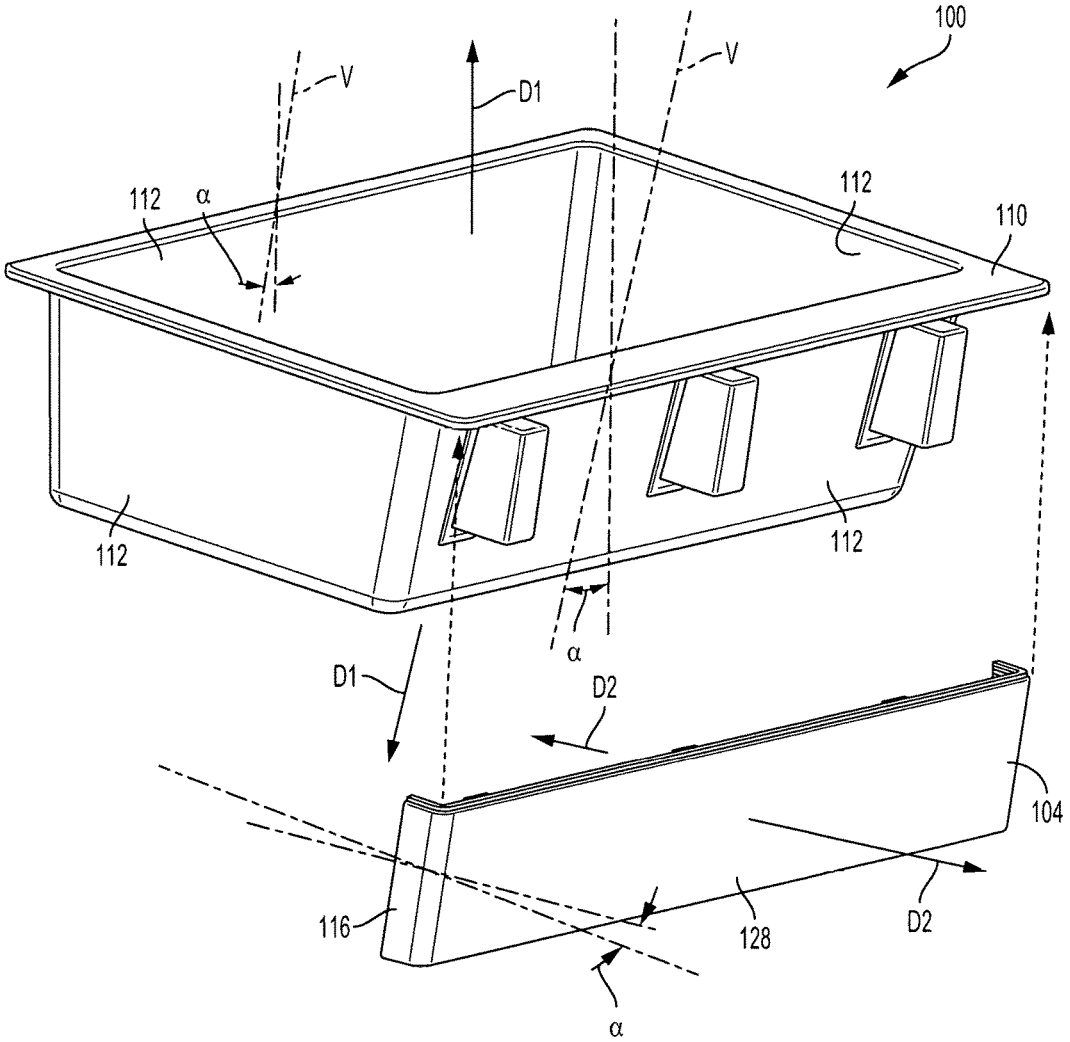
FIG. 3 is an exploded view of the sink of FIG. 1 showing the sink basin separated from the apron in accordance with the disclosure.
Figure 4:
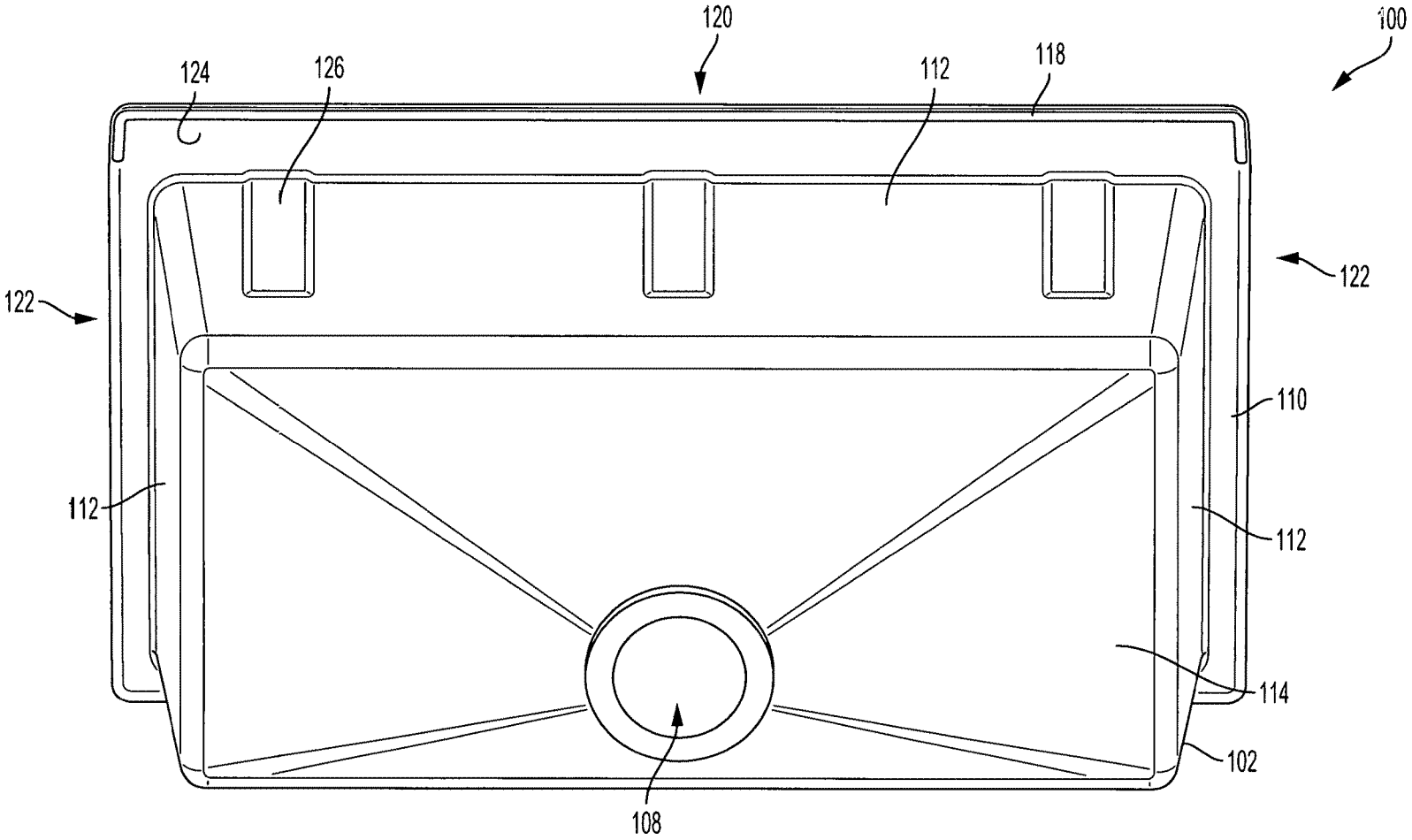
FIG. 4 is a bottom view of the sink basin shown separated from the apron of the sink of FIG. 1.

As is also shown in FIG. 2 and in FIG. 3, the walls 112 are disposed along angled planes that converge in a direction from the top flange 110 towards the floor 114 to form a generally inverted, truncated pyramid. The inclination angle, $\alpha$, of the walls 112 towards one another is a draft angle and facilitates removal of the basin body 102 from a mold (not shown) during manufacturing. The angle $\alpha$ in the illustrated embodiment is about 2.5 degrees but other angles can be used. As shown in FIG. 2, the side walls 112 are inclined towards one another in a downward direction. A similar inclination exists in the front and rear walls 112, as shown in FIG. 3.

Advantageously, because of the two-piece construction that includes the basin body 102 and the apron 104, the draft angle $\alpha$ is not required on the side or front faces of the apron 104 as it is on the basin body 102. To elaborate, as can be seen in FIG. 2, the two side faces 116 of the apron 104 are disposed along vertical planes that are parallel to the vertical direction, V. The orientation of the two side faces 116 can be accomplished by configuring the basin body 102 and the apron 104 to be molded as separate pieces and by utilizing molds that separate along different directions. More specifically, in reference to FIG. 3, the draft angles α formed in the walls 112 are in a downward direction to facilitate a mold separation direction, D1, of a mold (not shown) used to form the basin body 102 along the vertical direction, as marked by arrows. With respect to the apron 104, the side faces 116 are disposed along planes that diverge in a direction from the front of the sink 100 towards the rear because of draft angles α that are configured for a mold separation direction D2 along a horizontal direction, which is perpendicular to the mold separation direction D1.

For aligning the basin body 102 with the apron 104, and for providing features that facilitate their connection, the sink 100 includes various structures and features as shown in FIGS. 4-7. More specifically, the basin body 102 includes a channel 118 extending along a front portion 120 and, at least partially, along two side portions 122 of an underside 124 of the top flange 110. The channel 118 is generally U-shaped and facilitates the positioning, alignment and adhesion of the apron 104 to the basin body 102. To that end, at least one (three shown) pads 126 that are raised relative to the front wall 112 are arranged along the basin body 102 along the front wall and below the underside 124 of the top flange 110.

Figure 5:
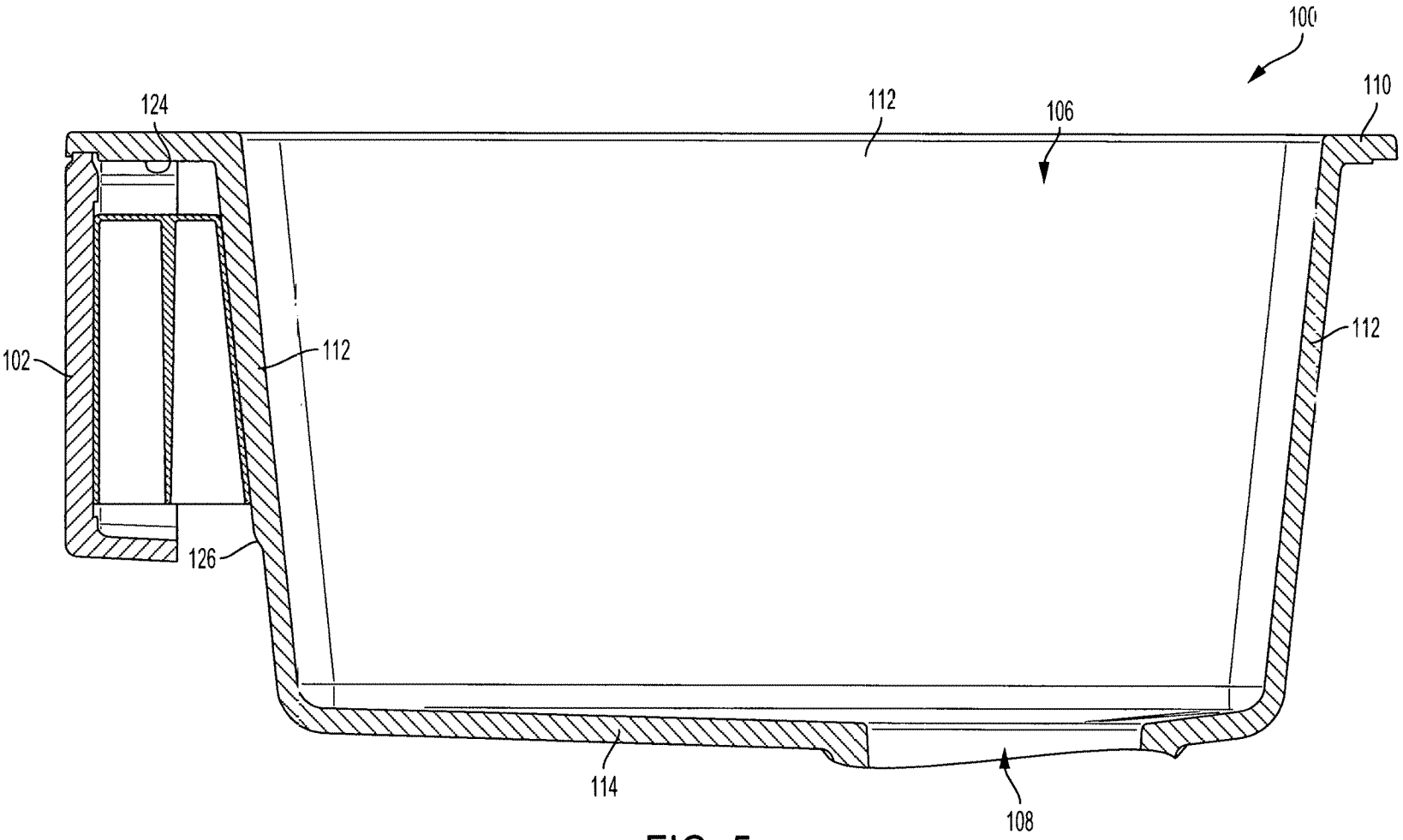
FIG. 5 is a cross sectional view of the sink of FIG. 1.
Figure 7:
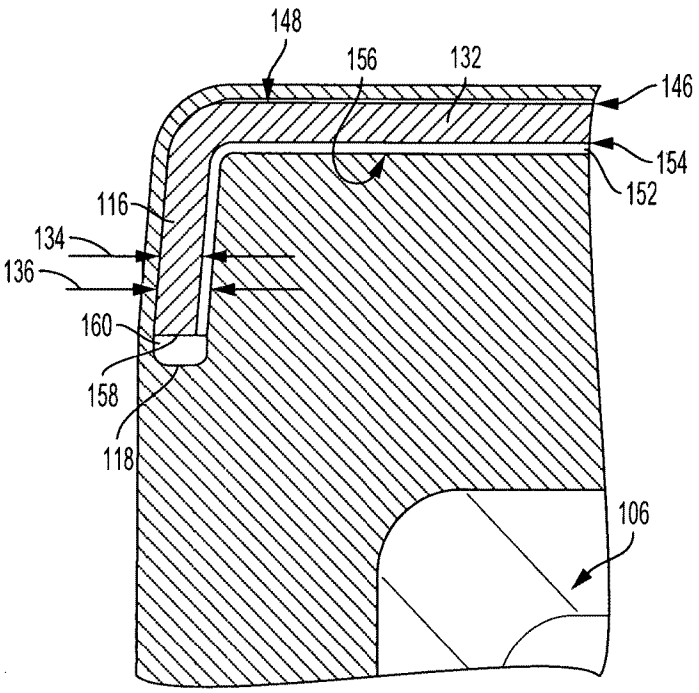
FIGS. 6 and 7 are enlarged, detail cross sections of the sink of FIG. 1.
Figure 6:
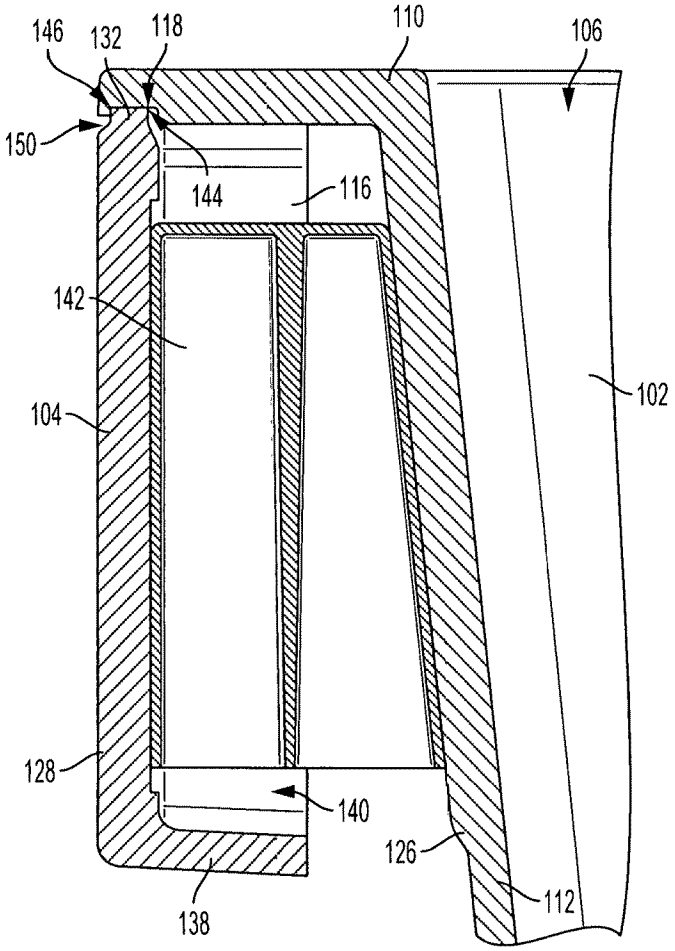

A cross section view through the assembled sink 100 is shown in FIG. 5, with enlarged, detail views shown in FIGS. 6 and 7. As can be seen from these figures, and also FIG. 3, the apron has a generally flat shape formed by a front apron wall 128 having two lateral ends 130 along which the two side faces 116 are attached. A reduced thickness flange 132, which has a thickness 134 that is narrower than a width 136 of the channel 118, is formed along the top end of the front apron wall 128. A bottom wall 138 is connected along a bottom portion of the front apron wall 128 and also along bottom portions of the side faces 116 to enclose an area 140 within the apron 104 and beneath the top flange 110 when the apron 104 is connected to the basin body 102. Spacing blocks 142 are connected between the outer surface of the front wall 112 and the rear face of the front apron wall 128. The spacing blocks 142 are located onto the pads 126.

When the apron 104 is assembled with the basin body 102, the reduced thickness flange 132 is placed into the channel 118 with an adhesive 144 disposed there between. Suitable adhesives include can include various types of glues and epoxies that are applied in a liquid state and then cured to a solid finish. To align the apron 104 with the basin body 102, when the reduced thickness flange 132 is placed in the channel 118, which is wider than the thickness of the flange, the apron 104 is pushed outwardly such that an outer edge 146 of the flange 132 abuts an outer wall 148 of the channel 118. In this way, the apron 104 is aligned along the front of the sink under the upper flange 110.

Optionally, a recess or reveal 150 may remain beneath the interface and along the reduced thickness flange 132 across the front of the sink 110 below the top flange 110 for visual effect. The positioning of the apron 104 within the channel 118 leaves a gap 152 between an inner edge 154 of the reduced thickness flange 132 and an inner wall 156 of the channel 118. In the illustrated embodiment, the gap 152, which extends along the channel 118 provides a clearance for properly seating the apron 104 while also providing a space to contain spillover of the adhesive 144 on the rear side of the apron 104 where it will not be visible on the finished sink 100. As is also shown in FIG. 7, the channel 118 may extend past an end 158 of the side faces 116 of the apron 104 to form an opening 160 that facilitates insertion of the apron 104 into the channel 118 and provides additional space to contain adhesive spillover during assembly.

Figure 8:
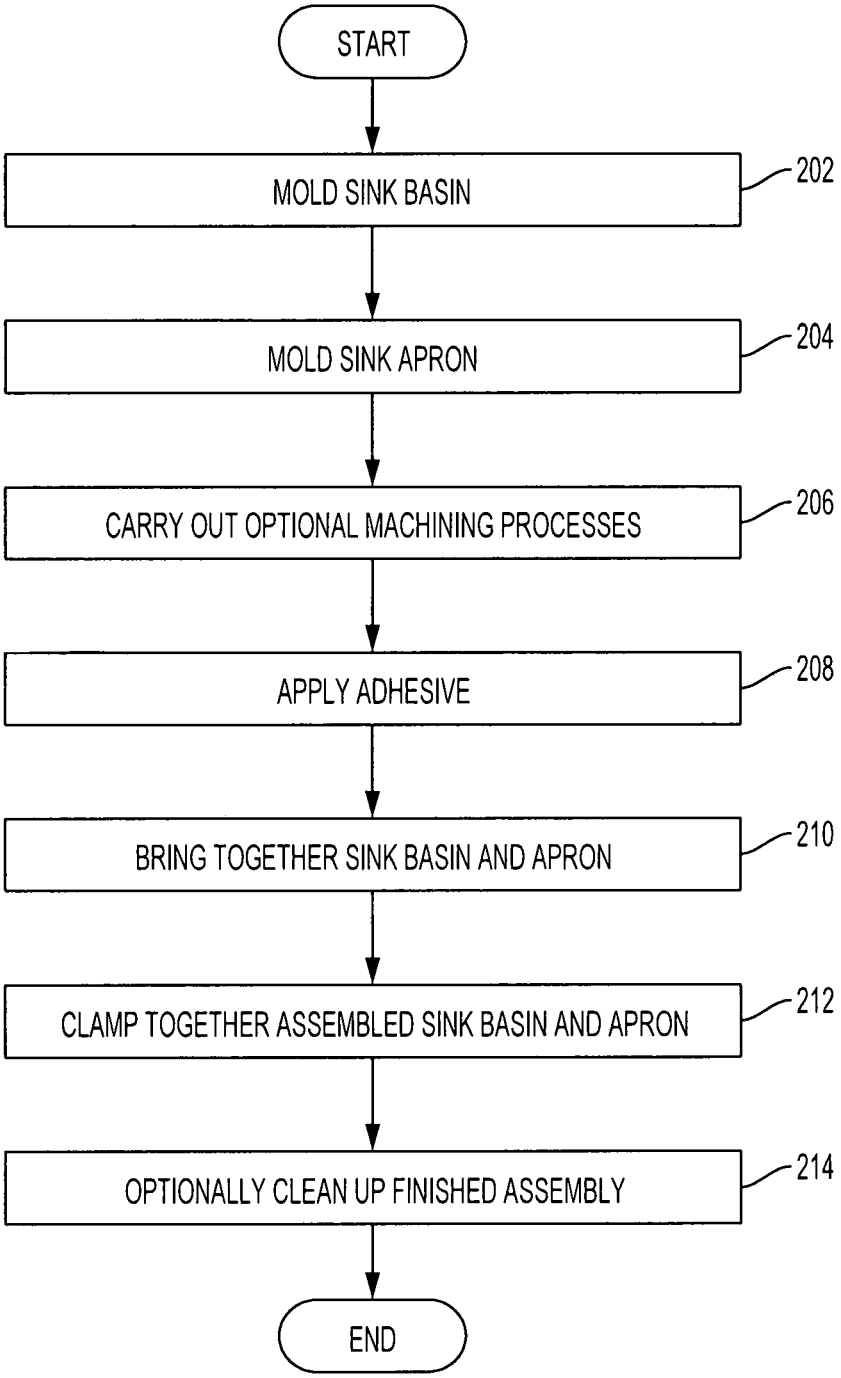
FIG. 8 is a flowchart for a method of manufacturing a sink in accordance with the disclosure.

A flowchart for a method of manufacturing an engineered stone sink with an apron is shown in FIG. 8. The manufacturing process begins with molding a sink basin at 202. The sink basin may be molded by a single, clamshell mold having two or more cooperating parts that form an exterior sink surface and one or more interior basins or bowls, which can be separated by partitions. The material to be molded may be poured or injected into the closed mold cavity and allowed to cure to form a solid structure. The mold may also roughly form a drain opening, although that is not necessary. The mold may also roughly form a channel extending along the underside of a top flange of the sink and at least partially along its sides. The mold may have a mold separation direction that is generally vertical with respect to the final mounting of the sink into a cabinet or base.

The manufacturing process may further include a molding operation at 204 to form a sink apron. The sink apron may include a front wall, which may be plain or include any desired designs and features, and two sidewalls that define side faces. The orientation between the sidewalls and the front wall may be along planes that converge or diverge with respect to the front wall to provide draft angles that permit mold separation for forming the apron along a generally horizontal direction with respect to the mounting orientation of the apron on the sink when the sink has been installed onto a cabinet. The mold used to form the apron, which may be a clamshell-type mold having two or more parts, includes a closed mold cavity into which the material to be molded may be poured or injected and then allowed to cure into a solid component. The mold may also roughly form various features of the apron such as a reduced thickness flange extending along the top edge of the apron.

After molding the sink basin and the apron, an optional machining process may be carried out on one or both components at 206 to refine and define the various features and their dimensions. In this respect, machining operations may be carried out to de-burr and square off an outer perimeter of the top flange, the drain opening, the channel extending on the underside of the top flange that accepts the apron, the top edge and other edges of the apron, the thickness of the reduced thickness flange along the top of the apron, and the like.

For assembling the finished sink basin with the apron, an adhesive may be applied along the channel in the underside of the top flange and/or the top edge of the reduced thickness flange of the apron at 208. Depending on the type of adhesive used, the adhesive may be allowed to begin setting before the apron is brought together with the sink basin at 210 by inserting the reduced thickness flange of the apron into the channel formed in the underside of the top flange of the sink basin. When bringing the parts of the sink together, the apron is aligned with the sink basin by moving the apron relative to the sink basin such that an outer, top edge of the reduced thickness flange abuts an outer wall of the channel. The sink basin and apron may optionally be clamped together at 212 to allow the adhesive to cure sufficiently to maintain the relative position and orientation of the apron and sink. Optionally, a final cleanup process may be carried out at 214 to remove any adhesive that spilled over during the assembly or curing process, which may occur especially for adhesives that expand during curing.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A sink, comprising:

a basin body having a generally concave shape that forms at least one sink basin, wherein the basin body includes four side walls surrounding a floor that includes a drain opening, and wherein the four side walls are disposed along respective angled planes that converge in a vertical direction from the top flange towards the floor to form a generally inverted, truncated pyramid shape;

a top flange integrally formed with the basin body, the top flange extending around a rim of the at least one sink basin, the top flange having an underside that is generally flat;

an apron connected onto a front portion of the underside of the top flange, the apron including a front wall extending along the vertical direction and two side faces disposed along respective vertical planes that are angled relative to one another in a horizontal direction such that the vertical planes diverge in a rearward direction away from the front wall; and an adhesive disposed between the apron and the underside of the top flange to secure the apron to the basin body;

wherein each of the basin body and the apron are made from an engineered stone material that is molded into a desired shape.

2. The sink of claim 1, wherein each of the respective planes is inclined with respect to vertical at a draft angle, $\alpha$.

3. The sink of claim 1, wherein the basin body includes a channel extending along a front portion and, at least partially, along two side portions of the underside of the top flange.

4. The sink of claim 3, wherein the channel is generally U-shaped and facilitates positioning, alignment and adhesion of the apron to the basin body.

5. The sink of claim 4, wherein the apron has a generally flat shape formed by a front apron wall having two lateral along which two side faces are attached, and wherein the apron includes a reduced thickness flange, which has a thickness that is narrower than a width of the channel and is formed along a top end of the front apron wall.

6. The sink of claim 5, wherein an outer edge of the reduced thickness flange of the apron abuts an outer wall of the channel.

7. The sink of claim 6, further comprising a gap formed between an inner edge of the reduced thickness flange and an inner wall of the channel, the gap extending along the channel and configured to contain spillover of the adhesive on a rear side of the apron.

8. A sink, comprising:

a molded basin body having a generally concave shape that forms at least one sink basin, the sink basin having a bottom wall and at least four side walls, the at least four side walls being disposed along angled planes that converge in a downward direction;

a top flange integrally formed with the basin body, the top flange extending around the at least one sink basin and being disposed along a horizontal plane;

a molded apron connected to a front portion of the top flange, the flange including two side faces disposed along angled planes that diverge in a rearward direction towards a rear of the sink such that they present vertical edges when viewed from a front of the sink.

9. The sink of claim 8, wherein the molded basin body is formed in a first mold having at least two pieces that separate in a vertical direction with respect to the sink, and wherein the molded apron is formed in a second mold having at least two pieces that separate in a horizontal direction.

* * * * *